United States Patent [19]

Groger

[11] 4,236,758

[45] Dec. 2, 1980

[54] RACK DRIVE FOR A DRUM CUTTER MINING MACHINE

[75] Inventor: Hans Groger, Essen-Steele-Horst, Fed. Rep. of Germany

[73] Assignee: Gebr. Eickhoff, Maschinenfabrik und Eisengiesserei m.b.H., Bochum, Fed. Rep. of Germany

[21] Appl. No.: 889,706

[22] Filed: Mar. 24, 1978

[30] Foreign Application Priority Data

Apr. 1, 1977 [DE] Fed. Rep. of Germany ..... 2714532

[51] Int. Cl.[3] ..... E21C 27/24; E21C 27/36

[52] U.S. Cl. ..... 299/42; 105/29 R

[58] Field of Search ..... 299/42–46, 299/51–54; 105/29 R

[56] References Cited

U.S. PATENT DOCUMENTS

| | | | |
|---|---|---|---|
| 1,027,078 | 5/1912 | Sessions | 105/29 R |
| 4,054,321 | 10/1977 | Jarvis | 299/43 |
| 4,088,370 | 5/1978 | Jarvis et al. | 299/53 |

FOREIGN PATENT DOCUMENTS

| | | | |
|---|---|---|---|
| 3112 | of 1872 | Italy | 105/29 R |

*Primary Examiner*—Ernest R. Purser

*Attorney, Agent, or Firm*—Thomas H. Murray; Clifford A. Poff

[57] ABSTRACT

A hollow gearwheel has internal teeth that mesh directly or through an intermediate gear with the teeth of a drive gear of a machine drive on a drum cutter mining machine. External teeth on the hollow gearwheel mesh with the teeth of a rack extending over the distance traversed by the mining machine along the face of a longwall mine. A plate pivots about the rotational axis of the drive gear while the plate forms a closure to the side of the hollow gearwheel facing the mining machine. The plate carries a bearing support for the arbor shaft of the hollow gearwheel and forms a seal along the outer peripheral edge of the hollow gearwheel. A carrier includes a bearing to support the outer end of the arbor shaft. The carrier is moved along a recess in a housing for the hollow gearwheel to adjust, by pivotal positioning, the hollow gearwheel.

6 Claims, 3 Drawing Figures

RACK DRIVE FOR A DRUM CUTTER MINING MACHINE

BACKGROUND OF THE INVENTION

The invention relates to a getting machine for underground mining, and more particularly to a drum cutter mining machine which is traversed along a rack extending over the machine traversing distance through a gear drive forming a drive relation between the rack teeth and a gearwheel transmissively connected to a driven wheel on the mining machine.

Getting machine of this same general type are known in the art. By constructional design, the overall height of the getting machine is selected to work seams having a particular range of thickness. The overall height is substantially defined by the height of the machine frame on which the machine body is supported. Typically, a traversing drive is provided wherein the machine frame supports a gearwheel while driven by the drive wheel of a drive. The gearwheel meshes with the rack teeth from above with the rack. In this way, there is established a transmissive connection between the driven drive wheel and the rack teeth, which connection is either direct or through an intermediate wheel supported on the machine frame. The elevational height of the rack approaches relatively closely the level of the machine frame in a mine with thin seams because these seams are worked by a getting machine with a relatively low machine frame height. Accordingly, the gearwheel cannot be supported beneath the drive wheel of the drive as in the case of tall drum cutter machines used to work thick seams but the gearwheel can only be arranged and supported adjacent the drive wheel.

SUMMARY OF THE INVENTION

It is the object of the invention to provide a particularly compact transmissive connection between thee teeth of a rack and the drive wheel of the machine drive of a drum cutter mining machine for traversing movement thereof along the face of an underground mine.

The present invention provides a drum cutter mining machine of the type traversed along a rack device extending over the distance traversed by the mining machine for movement thereof along the face of an underground mine, the drum cutter mining machine including a prime mover coupled to rotate a drive gearwheel, the combination therewith of apparatus to couple the drive gearwheel with the rack device at the side of the mining machine opposite the mine face, the apparatus including a hollow gearwheel including internal gear teeth drivingly coupled to the drive gearwheel for rotation by the prime mover, the hollow gearwheel further including external gear teeth to mesh with teeth of the rack device.

Thus, the present invention provides in a getting machine for underground mining a gearwheel to mesh with the rack teeth wherein the gearwheel is constructed as a hollow wheel and is provided with internal teeth adapted to mesh with the drive wheel of the machine drive. A gearwheel constructed in this way is particularly suitable for use in a getting machine having a low to medium height because the gearwheel surrounds the drive wheel of the machine drive. The gearwheel drive arrangement according to the present invention provides a spatially compact transmissive connection between the rack and the drive wheel, even when the distance between the rack teeth and the drive wheel teeth is relatively small. Wear of those teeth on the gearwheel which mesh with the rack is substantially reduced because the diameter of the gearwheel of present invention is usually larger than that of known forms of gear drives associated with a rack. Furthermore, because the drive wheel meshes with the internal teeth of the gearwheel, i.e., with its own internal gearing which is closed with respect to the exterior, the gearwheel according to the invention offers better efficiency as compared with a gear drive where the drive wheel meshes with external rack teeth and the teeth of a drive wheel of the machine drive.

Conveniently, the gearwheel is closed on the machine side by a plate which is supported so as to be pivotal about the axis of the drive wheel. The plate supports a bearing of the gearwheel and can be locked in different pivoting positions. By means of this plate, the gearwheel can be pivoted about the axis of the drive wheel and located at a set position corresponding to the prevailing level of the rack teeth.

It is also advantageous to provide a housing having an open bottom and surrounding the gearwheel. The housing is rigidly mounted onto the machine body or onto a machine frame. The wall of the housing at the stowing side has a slot-like recess extending centrally with respect to the rotational axis of the drive wheel. One of two bearings for the gearwheel is carried by a sliding block which is guided for sliding movement along the recess and connected to the housing at one of different positions. A getting machine constructed in this manner can be arranged so that both gearwheel end faces engage by means of concentrically-disposed annular projections with corresponding recesses in the plate or the sliding block to form a labyrinth to prevent the escape of lubricant or the ingress of dust.

It is within the scope and spirit of the pesent invention to provide at least one intermediate wheel to transmissively couple the internal teeth of the gearwheel with the teeth of the drive wheel. When appropriate, the intermediate wheel or wheels is situated eccentrically with respect to the axis of the gearwheel. In this gearwheel arrangement, the position of the gearwheel with respect to the drive wheel of the drive can be altered by using one or more intermediate wheels of different dimensions. Thus, it is possible to achieve additional adaptation of the gearwheel position to the prevailing rack level. By using a plurality of intermediate wheels it is also possible to transmit torque from the drive wheel with a substantially reduced tooth pressure on the gearwheel, a feature which is particularly advantageous for winches designed for large tractive forces.

It is also advantageous if two intermediate wheels, which mesh with the internal teeth of the gearwheel, are disposed on oppositely-situated circumferential sides of the drive wheel. An arrangement of this kind not only reduces the tooth pressures but also relieves the load on the bearing of the winch drive wheel.

These features and advantages of the present invention as well as others will be more fully understood when the following description is read in light of the accompanying drawings, wherein.

Figure 1:
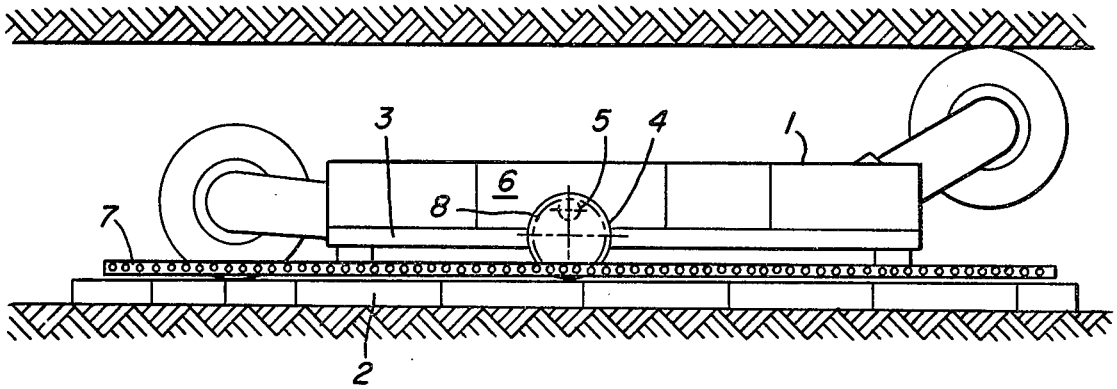
FIG. 1 is a side view of a drum cutter mining machine which is traversed along a face conveyor through a drive coupled to a gear rack according to one embodiment of the present invention.

In FIG. 1, there is illustrated a drum cutter mining machine 1 traversable upon a face conveyor 2 to release or cut material from a mine face through the use of cutting drums carried by vertically pivotal arms at the opposite ends of the mining machine. To work thin seams, the height of the machine 1 is appropriately reduced as compared with the height of a mining machine used to work thick seams. A rack 7 is preferably made up of individual rack segments joined together in an end-to-end relation to extend over the distance traversed by the mining machine of the mine face. The rack 7 has teeth formed by spaced-apart pins or rods 7A supported by side members 7B. The mining machine is moved along the face conveyor by a rack drive which includes a gearwheel 4 supported on a machine frame 3 and driven by a drive wheel 5 of a drive 6 forming a prime mover. The gearwheel 4 is constructed as a hollow wheel with internal teeth 8 which mesh with the teeth of the drive wheel 5 of the winch. In this embodiment, the gearwheel 4 is rigidly, i.e., non-adjustably, supported on the machine frame 3 of the drum cutter mining machine 1. External teeth on the gearwheel 4 mesh with the teeth of the rack 7.

Figure 2:
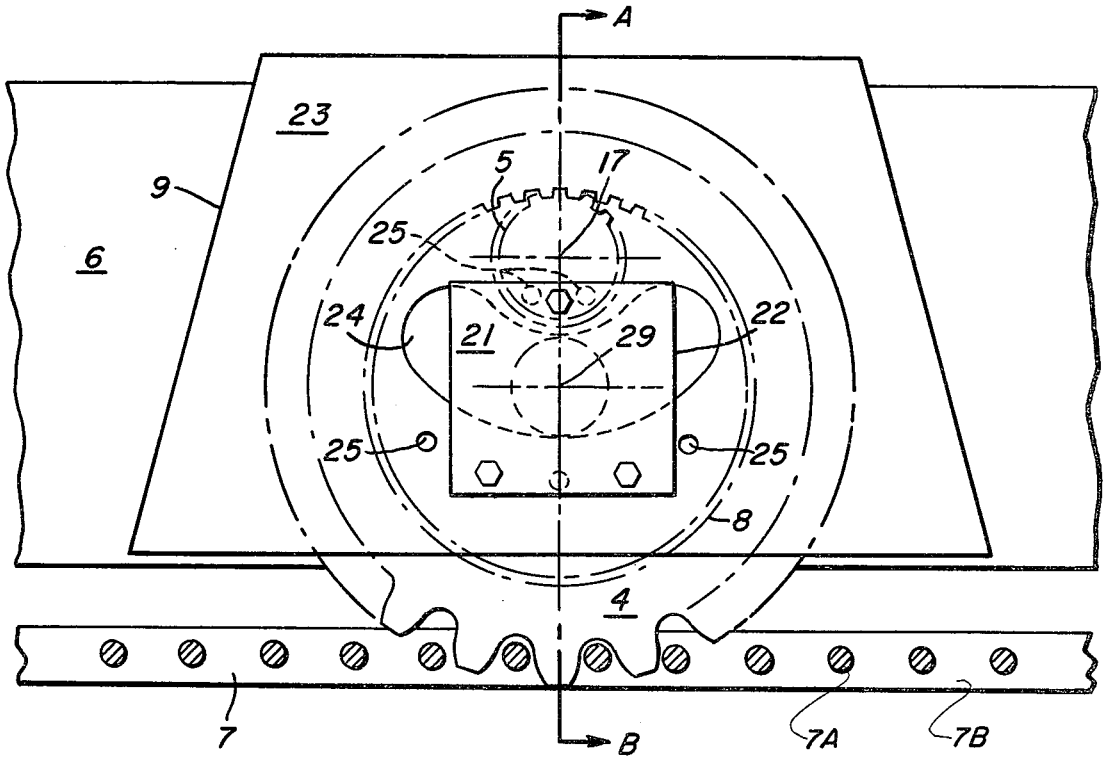
FIG. 2 is an enlarged view of a further embodiment of the drive for the drum cutter machine shown in FIG. 1.
Figure 3:
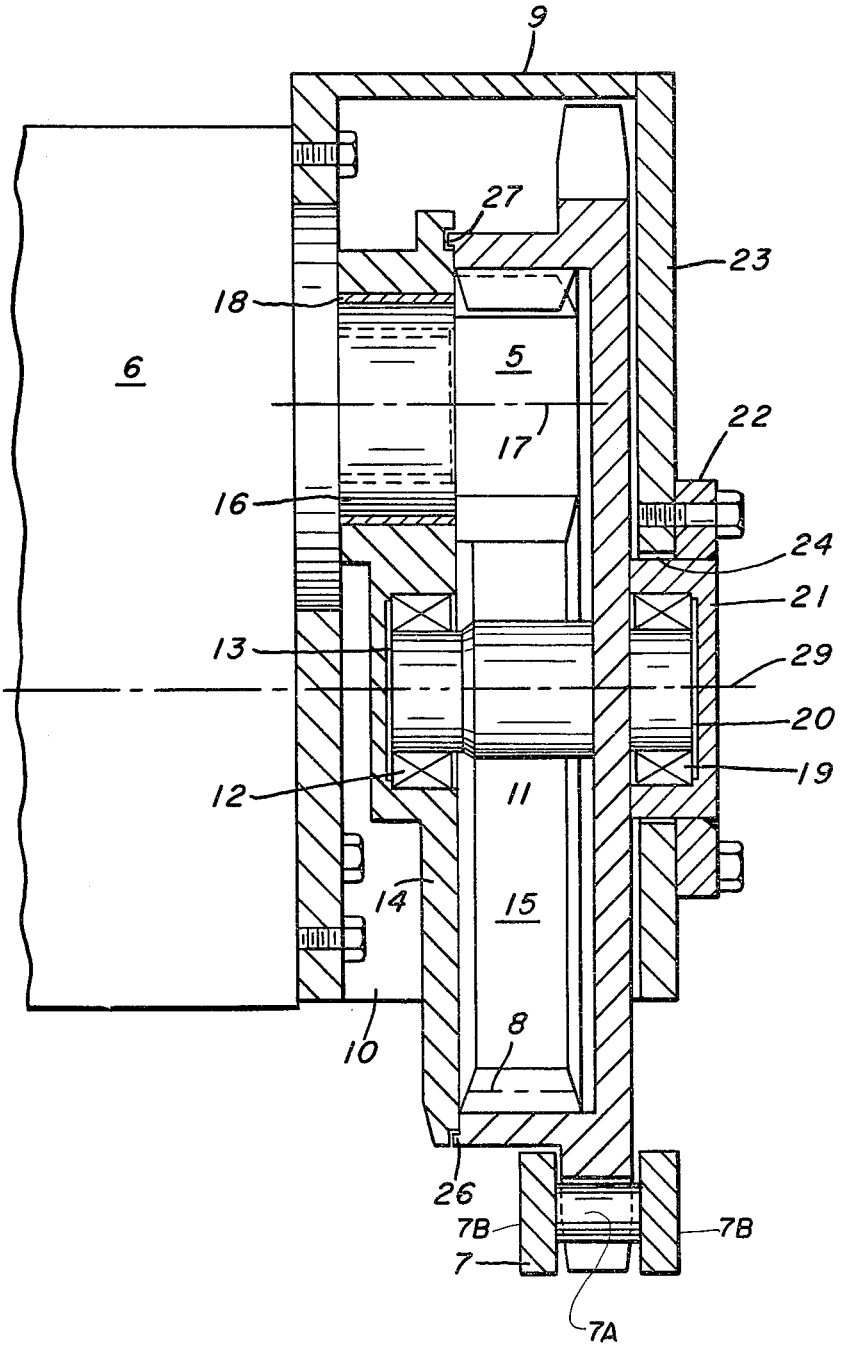
FIG. 3 is a sectional view taken along line A-B of FIG. 2.

In the embodiment illustrated in FIGS. 2 and 3, the gearwheel 4 is surrounded by a housing 9 which is mounted onto the side wall of the machine body or onto the machine frame 3, for example, by bolts. The housing 9 has a bottom opening 10 through which gearwheel 4 projects downwardly so that the external gear teeth mesh with the teeth of the gear rack 7. In this embodiment, an arbor or shaft 11 of the gearwheel 4 is supported, at the machine side, by a roller bearing 12 which is situated within a recessed portion 13 of a plate 14. the plate 14 closes the interior space 15 of the gearwheel 4 which is constructed as a hollow wheel, i.e., a wheel with a support wall section spaced outwardly from the teeth on the gear rim portion. The plate 14 is supported by an extension 16 of the housing. The extension 16 is situated centrally with respect to the rotational axis 17 of the drive wheel 5. The plate 14 is carried on a bushing 18 so that the plate is pivotal about the axis 17 of the drive wheel 5. A roller bearing 19, at the stowing side of the gearwheel 4, rotatably supports the free end of shaft 11. The roller bearing 19 is situated in a recess 20 of a sliding block 21 having a flange 22 bolted to the external wall 23 of the housing 9. External wall 23 is removably attached by bolts or the like to the casing forming the remaining part of housing 9. A slot-like recess 24 in the external wall 23 extends centrally with respect to the axis 17 of the drive wheel 5 and accommodates the sliding block 21. As best shown in FIG. 2, by this construction, the sliding block is guided during sliding movement along the recess to provide adjustable movement along both elongated portions of the recess. The sliding movement of block 21 provides adjustment to the penetration depth by the meshing teeth on the gearwheel 4 and rack 7. Thus, gearwheel 4 is adapted to the relevant position of the rack. Groups of holes 25 in the wall 23 are provided for securing the sliding block 21 at the selected operating position for the gearwheel 4. A tightly-sealed closure to the interior space 15 in the gearwheel 4 is provided by forming a recess 27 in the plate 14 to receive an annular extension 26. The recess 27 and extension 26 are both concentric with respect to the gearwheel shaft 11 to form a labyrinth to prevent the escape of lubricant and the ingress of dust.

In the embodiment according to FIG. 1 as well as in the embodiment illustrated in FIGS. 2 and 3, the drive wheel 5 meshes directly with the internal teeth 8 of the gearwheel 4 which is constructed as a hollow wheel. It is within the scope of the present invention to employ one or more intermediate gearwheels to provide transmissive connection between the drive wheel 5 and the internal teeth 8 of the gearwheel 4. Since the drive wheel 5 in the illustrated embodiments is situated concentrically with respect to the axis of the gearwheel 4, it follows that intermediate wheels may be appropriately arranged at opposite circumferential sides of the drive wheel. Three intermediate wheels can be used with a suitable construction of parts.

Although the invention has been shown in connection with certain specific embodiments, it will be readily apparent to those skilled in the art that various changes in form and arrangement of parts may be made to suit requirements without departing from the spirit and scope of the invention

I claim:

1. In a drum cutter mining machine of the type traversed along a track device extending over the distance traversed by the mining machine for movement thereof along the face of an underground mine, said drum cutter mining machine including a prime mover coupled to rotate a drive gearwheel about a first axis, the combination therewith of apparatus to couple said drive gearwheel with a rack device at the side of the mining machine opposite the mine face, said apparatus including a hollow gearwheel including internal gear teeth drivingly coupled to said drive gearwheel for rotation by said prime mover about a second axis spaced from said first axis, said hollow gearwheel further including external gear teeth to mesh with teeth of said rack device.

2. The apparatus according to claim 1 further including a plate member supported for pivotal movement about the rotational axis of said drive gearwheel to close the side of said hollow gearwheel facing toward said mining machine, bearing means carried by said plate member for rotatable support of said hollow gearwheel, and means to retain said plate member at a desired pivoted position.

3. The apparatus according to claim 1 further including a housing rigidly mounted onto said mining machine for surrounding a portion of said hollow gearwheel, said housing having an opening in the bottom wall thereof for meshing engagement of the external teeth of said hollow gearwheel with the teeth of said rack device, said housing further having a slot-like recess in the side wall facing outwardly from the mining machine, said slot-like recess extending centrally with respect to the rotational axis of said drive gearwheel, and a carrier including bearing means connected to said housing at a desired location within said recess to rotatably support said hollow gearwheel.

4. The apparatus according to claim 3 wherein said hollow gearwheel includes an arbor shaft supported by said carrier.

5. The apparatus according to claim 2 further including means forming a lubricant and dust impervious seal between said hollow gearwheel and said plate member.

6. The apparatus according to claim 5 wherein said lubricant and dust impervious seal includes an annular projection extending into an annular recess to form a labyrinth between mating face surfaces on said hollow gearwheel and said plate member.

* * * * *